United States Patent [19]

Robinette

[11] 4,414,179

[45] Nov. 8, 1983

[54] PROCESS FOR MAKING PHOTORECEPTORS

[75] Inventor: Susan L. Robinette, Webster, N.Y.

[73] Assignee: Xerox Corporation, Stamford, Conn.

[21] Appl. No.: 326,997

[22] Filed: Dec. 3, 1981

[51] Int. Cl.[3] ..... C22C 1/02; C22C 28/00

[52] U.S. Cl. ..... 420/579; 75/65 R; 430/86

[58] Field of Search ..... 420/579; 75/65 R, 93 R, 75/111, 121; 430/85, 86, 95

[56] References Cited

U.S. PATENT DOCUMENTS

| | | | |
|---|---|---|---|
| 2,803,542 | 8/1957 | Ullrich | 430/85 X |
| 3,312,548 | 4/1967 | Straughan | 430/85 X |
| 3,785,806 | 1/1974 | Henriksson | 430/95 X |
| 3,867,143 | 2/1975 | Tanaka et al. | 430/86 |
| 3,973,960 | 8/1976 | Dulken et al. | 430/85 |
| 4,126,457 | 11/1978 | Ciuffini | 430/86 X |
| 4,226,929 | 10/1980 | Teshima et al. | 430/57 |
| 4,286,035 | 8/1981 | Nishizima et al. | 430/85 |
| 4,297,424 | 10/1981 | Hewitt | 430/86 X |
| 4,338,387 | 7/1982 | Hewitt | 430/85 X |

FOREIGN PATENT DOCUMENTS 1031864 6/1966 United Kingdom .

*Primary Examiner*—L. Dewayne Rutledge
*Assistant Examiner*—David A. Hey
*Attorney, Agent, or Firm*—Peter H. Kondo; John E. Beck; Ronald Zibelli

[57] ABSTRACT

A process for preparing a selenium alloy highly resistant to the development of persistant bulk space charge during prolonged, electrophotographic cycling comprising heating a mixture comprising selenium, arsenic and chlorine to a temperature between about 290° C. and about 330° C. to form a molten mixture, agitating the molten mixture to blend the components therein, discontinuing or substantially discontinuing all agitation of the mixture to achieve a quiescent state for the mixture, raising the temperature of the mixture to at least about 420° C. for at least about 30 minutes and cooling the mixture until it becomes a solid.

10 Claims, 2 Drawing Figures

PROCESS FOR MAKING PHOTORECEPTORS

This invention relates in general to electrophotography and, more specifically, to a novel process of making a photoconductive composition.

In the art of electrophotography, an electrophotographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a receiving member such as paper. This imaging process may be repeated many times with reusable photoconductive insulating layers.

As more advanced, faster copiers and duplicators were developed, degradation of image quality was encountered. For example, when a selenium alloy photoreceptor is cycled rapidly relative to the decay times of trapped charge, a persistant bulk positive space charge (residual potential) develops. If the residual potential increases over many electrophotographic imaging cycles, unacceptably high levels of residual potential will occur during prolonged cycling. This increase in residual potential upon cycling can lead to serious image degradation. As the magnitude of the persistant bulk positive space charge increases, toner deposition in the background areas of the photoconductive layer increases and contrast decreases in solid areas to levels where they are unacceptable for many high quality commercial applications. Moreover, cycle-up caused by the build-up of residual charge or potential is characterized by xerographic copy images initially appearing as light density images and thereafter progressively becoming darker with each imaging cycle. Although sophisticated electronic equipment ranging from manual to microprocessor controlled systems may be installed in copiers and duplicators to help compensate for this constant change in photoreceptor properties, there is an urgent need for a photoreceptor which would eliminate the necessity for such complex and costly devices. It has also been observed that photoreceptors which exhibit an increase to high levels of residual charge tend to form images of varying density across a copy sheet, particularly when the images comprise large solid areas. This characteristic is believed to be the result of the high residual charge properties of the photoreceptor coupled with the manner in which the photoconductive coating is formed. However, photoreceptors which have low residual potential characteristics provide more consistent density across each copy sheet.

Electrophotographic plates may comprise a single photoconductive layer or multiple layers in which one or more of the multiple layers are photoconductive. Electrophotographic plates in which the photoconductive layer contains selenium or selenium alloys are particularly well known in the art. Further, electrophotographic plates containing selenium alloys doped with halogens such as chlorine, are described in the prior art, for example, by V. Straughan in U.S. Pat. No. 3,312,548, Dulken et al in U.S. Pat. No. 3,973,960, and Nishizima et al. in U.S. Pat. No. 4,286,035, and Teshima et al. in U.S. Pat. No. 4,226,929. Generally speaking, excellent images can be obtained with selenium alloy photoreceptors doped with halogen. Dulken et al, Teshima et al, and Nishizima et al also disclose the addition of halogen to selenium alloys to reduce or prevent residual potential. It should be noted, however, that many of the claims made in the literature for selenium alloy photoreceptors were based on samples made in small quantities in sealed ampoules. Properties exhibited by selenium alloys made in large open pot production facilities are often not the same as those of selenium alloys made in small sealed amopules. Straughan in U.S. Pat. No. 3,312,548 discloses heating a mixture of selenium, arsenic and iodine in a sealed Pyrex vial to a temperature of about 525° C., in a rocking furnace for about three or four hours. Tanaka et al disclose in U.S. Pat. No. 3,867,143 that a mixture of Se, Sb and Te sealed in a vacuum quartz tube can be heated for six hours and then poured into distilled water to form powder solid matter.

It is an object of this invention to provide a novel process for making a photoconductive insulating composition which overcomes the above-noted disadvantages.

It is another object of this invention to provide a novel process for making a photoconductive insulating composition in large batch quantities.

It is another object of this invention to provide a novel process for making a photoconductive insulating composition which minimizes development of bulk positive space charge in high speed electrophotographic imaging systems.

The foregoing objects and others are accomplished in accordance with this invention by providing a process comprising heating a mixture comprising selenium, arsenic and chlorine to a temperature between about 290° C. and about 330° C. to form a molten mixture, agitating the molten mixture to blend the components therein, discontinuing or substantially discontinuing all agitation of the mixture, raising the temperature of the mixture to at least about 420° C. for least about 30 minutes, and cooling the mixture until it becomes a solid.

In general, photoconductive insulating layers having excellent resistance against residual potential build-up can be obtained by controlling the process variables of the instant invention to form an alloy product comprising selenium, about 0.3 percent by weight to about 0.5 percent by weight arsenic, based on the total weight of the solid alloy, and about 50 parts per million to about 150 parts per million chlorine, based on the total weight of the solid alloy product.

More specifically, improved hardness and suppression of selenium crystallization are achieved when a solid alloy product of this process contains at least about 0.3 percent by weight of arsenic. Objectional charge build-up is observed in high speed copier duplicators when the alloy product contains more than about 0.5 percent by weight arsenic. Optimum electrophotographic properties are achieved when the solid alloy product contains about 0.36 percent by weight arsenic.

If the final solid alloy product contains less than about 50 parts per million chlorine, undesirable charge build-up can occur in high speed copiers and duplicators. Amounts of chlorine exceeding about 150 parts per million tend to cause unacceptable rates of dark decay unless the arsenic content is increased. A range of chlorine between about 60 parts per million to about 140 parts per million is preferred for optimum performance in high speed duplicators.

The total quantity of the starting mixture or batch employed in the process of this invention affects the selection of process variables to achieve the desired proportions of selenium, arsenic, and chlorine in the solid alloy product. For example, when small batches are processed, sizable losses of volatiles such as arsenic and chlorine compounds can occur. To overcome this loss, it has been found, that an excess of arsenic and chlorine should be added to small starting batches. For example, about 10 percent excess of arsenic and chlorine is employed for batches weighing about one kilogram to achieve the desired selenium arsenic and chlorine concentrations in the solid alloy product. In other words, if 0.40 percent by weight arsenic and 100 ppm chlorine is desired in the final alloy product, one would use about 0.44 percent by weight arsenic and about 110 ppm chlorine in the starting mixture. However, in large starting batches greater than about 20 kilograms, no significant loss of volatiles such as arsenic and chlorine compounds are observed and no excess arsenic and chlorine appear necessary in the starting mixture. Although it is not entirely clear, the size of the exposed upper surface area of the molten mixture relative to the total alloy mass may affect the rate of loss of volatiles such as arsenic and chlorine. Obviously, the total period during which the mixture is molten and the degree of agitation of the molten mixture may also affect the rate of loss of volatiles.

When starting batches greater than about 10 kilograms are used, mechanical premixing is desirable to insure sufficient homogenization of the starting materials. Mechanical premixing is particularly desirable where the components are introduced as shot with various shot particles comprising different components or different proportions of components such as shot containing selenium and arsenic mixed with shot containing selenium and chlorine, and the batch size is about equal to or greater than about 40 kilograms. Premixing helps blend layers which may have formed from sequential introduction of shot having differing concentrations of components. As is well known in the art, high concentrations of additives in selenium are introduced in the starting mixture using conventional master batching techniques. Mechanical premixing of the components at about room temperature for large batches also obviates any need for more vigorous mixing when the mixture is molten thereby minimizing loss of volatiles such as arsenic and chlorine compounds during alloying. Any suitable shot size may be employed. A shot size between about 1 mm and about 3 mm is especially convenient for processing. Premixing may be effected in any suitable non-reactive vessel. Examples of non-reactive vessels include quartz, Pyrex, stainless steel coated with silicon and the like. The premixing vessel may be used throughout most of the alloying process. Mechanical mixing may be accomplished with the aid of any suitable device such as stirring rods, helical blades, propellers, paddles and the like.

After premixing of the starting mixture, if premixing is employed, the alloy components should be heated until the mixture is molten. Since blending of the molten mixture by a suitable agitation technique such as stirring is difficult to effect at low temperatures when the molten mixture is highly viscous, a temperature of at least about 290° C. is preferred during the agitation step. The molten mixture may, if desired, be heated as high as about 330° C. At higher temperatures, the rate of loss volatiles such as arsenic and chlorine compounds becomes undesirably high. As indicated above, any suitable non-reactive heat resistant vessel may be utilized during agitation of the molten mixture. The vessel may comprise an open or pressure regulated device. Similarly, any well-known, non-reactive agitation means may be employed to mix or stir the molten mixture. Agitation of small quantities of the molten mixture can be carried out by merely introducing a stream of non-reactive, sparging gas beneath the surface of the molten mixture.

Agitation of the molten mixture should normally be conducted for between about 30 minutes to about 1 hour, 30 minutes. Generally, agitation of the molten mixture for less than about 30 minutes can result in non-uniformity of the alloy, even for smaller batches. Moreover, the length of the agitation period also depends to some extent upon the size of the batch. For example, less stirring time is necessary for small batches compared to large batches. Agitation can be effected for more than 1 hour and 30 minutes but loss of the volatile components will increase. Moreover, energy would be needlessly expended. Optimum alloy uniformity is achieved with an agitation period of about 1 hour. Agitation of the molten mixture should be carried out in an inert atmosphere to avoid the adverse effects of reactive contaminants such as oxygen. Any suitable inert sparge gas such as nitrogen, argon, carbon dioxide or the like, can be introduced into the vessel during heating on a one time basis, periodically or continuously. Excessive sparging rates should be avoided because of the high loss of voltatiles such as arsenic and chlorine compounds. Agitation may be effected at atmospheric pressure or at elevated pressures. The pressure may be regulated by conventional means such as open ports, vents, pressure relief valves, and the like. Operator safety appears to be the primary constraint in the selection of pressures employed. For example, pressures up to about two atmospheres can be safely employed with closed heavy, three port, round bottom, quartz vessels. However, satisfactory results may be achieved when, for example, at least one of the ports in the quartz vessel is open to the atmosphere.

At or near the end of the agitation step of the present invention, the temperature of the molten mixture is raised to a temperature between about 425° C. and about 500° C. Any suitable conventional means may be utilized to heat the alloy mixture. Typical heating systems include mantles, ovens, and the like. The rate of heating does not appear to be critical. Batch size tends to limit the rate of heating. In other words, larger batches will take longer to heat. However, rapid heating would normally be desirable because it would increase throughput. After the temperature of the molten mixture has been raised or as the temperature of the molten mixture is being raised, the agitation of the molten mixture is discontinued or substantially discontinued to allow the molten mixture to attain a quiescent state. Agitation may be terminated completely while the molten mixture is maintained in a quescient state at elevated temperatures. In fact, agitation should be totally avoided for small batches. Slight agitation by gentle stirring or gentle sparging may be used for very large batches such as those exceeding about 45 kilograms. Generally speaking, little or no perceptable movement of the molten mixture is observed with slight agitation. However, complete termination of agitation including gas sparging is preferred for all batch sizes because less volatiles are lost, less energy is expended and optimum resistance to development of residual potential is achieved in the final solid alloy product of the process. The length of time employed for maintaining the molten mixture at elevated temperatures depends upon the batch size and the specific elevated temperatures employed. Satisfactory results may be achieved when the molten mixture is maintained at elevated temperatures for between about 30 minutes to about 3 hours. However, the benefits of resistance to the development of space charge diminishes greatly when times of less than about 30 minutes are employed. Times exceeding about 3 hours contributes to the excessive loss of volatile components such as arsenic and chlorine compounds. For example, good results are achieved when the quiescent state is maintained for about three hours at a temperature of about 425° C. or at about 1 hour when a temperature of about 500° C. is used. At temperatures higher than about 500° C., the loss of volatile materials such as arsenic and chlorine compounds tends to become excessive. Optimum minimization of the development of persistant bulk space charge in the final alloy product is achieved when the quiescent molten mixture is maintained at a temperature between about 450° C. to about 475° C. for about 1 to about 2 hours. This step of maintaining the molten mixture at elevated temperatures in a quiescent state is essential for producing an alloy product exhibiting low cycle-up behavior. As is well known in the art, cycle-up is caused by development of persistant bulk positive space charge, i.e. residual potential, during repeated cycling of the photoreceptor in an electrophotographic imaging process, particularly when cycling is carried out at high rates.

After the quiscent state step is completed, the alloy is allowed to cool to a solid. Cooling may be accomplished by any suitable technique such as shotting, casting, and the like. Since alloy shot is preferred for handling purposes, the alloy can, for example, be cooled to 300° C. and thereafter channeled through a non-reactive, heat resistant perforated material such as a shotter head to form droplets of alloy. These droplets may be permitted to fall into a coolant liquid such as water. Formation of shot at temperatures between about 290° C. and about 310° provides adequate viscosity for shot formation. The droplets may be cooled by any suitable technique. Typical cooling techniques include immersion in a cooling fluid, free fall in a shot tower, impact with a chilled conductive surface and the like. Preferably, formation and cooling of the shot particles is carried out in a suitable inert gas such as nitrogen, argon, carbon dioxide or the like to prevent undesirable reactions with contaminants. The rate of cooling does not appear to be critical. For example, the same reduction in cycle-up characteristics was obtained from samples taken from a 1 kilogram batch cooled from 450° C. in about 20 minutes and a 27 kilogram batch cooled in about 2 hours. To further illustrate the non-criticality of the cooling step, no difference was found in the electrical properties with and cast and shotted alloys nor between shot formed in ice water and shot formed in water maintained at a temperature of about 20° C.

In general, the advantages of the improved process of this invention will become apparent upon consideration of the following disclosure of the invention, especially when taken in conjunction with the accompanying drawings wherein.

The figures above taken with the following examples, further specifically define the present invention with respect to a method of making a photoconductive insulating alloy. Percentages are by weight unless otherwise indicated. The illustrations above and the examples below, other than the control examples, are intended to illustrate various preferred embodiments of the instant invention.

EXAMPLE I

Figure 1:
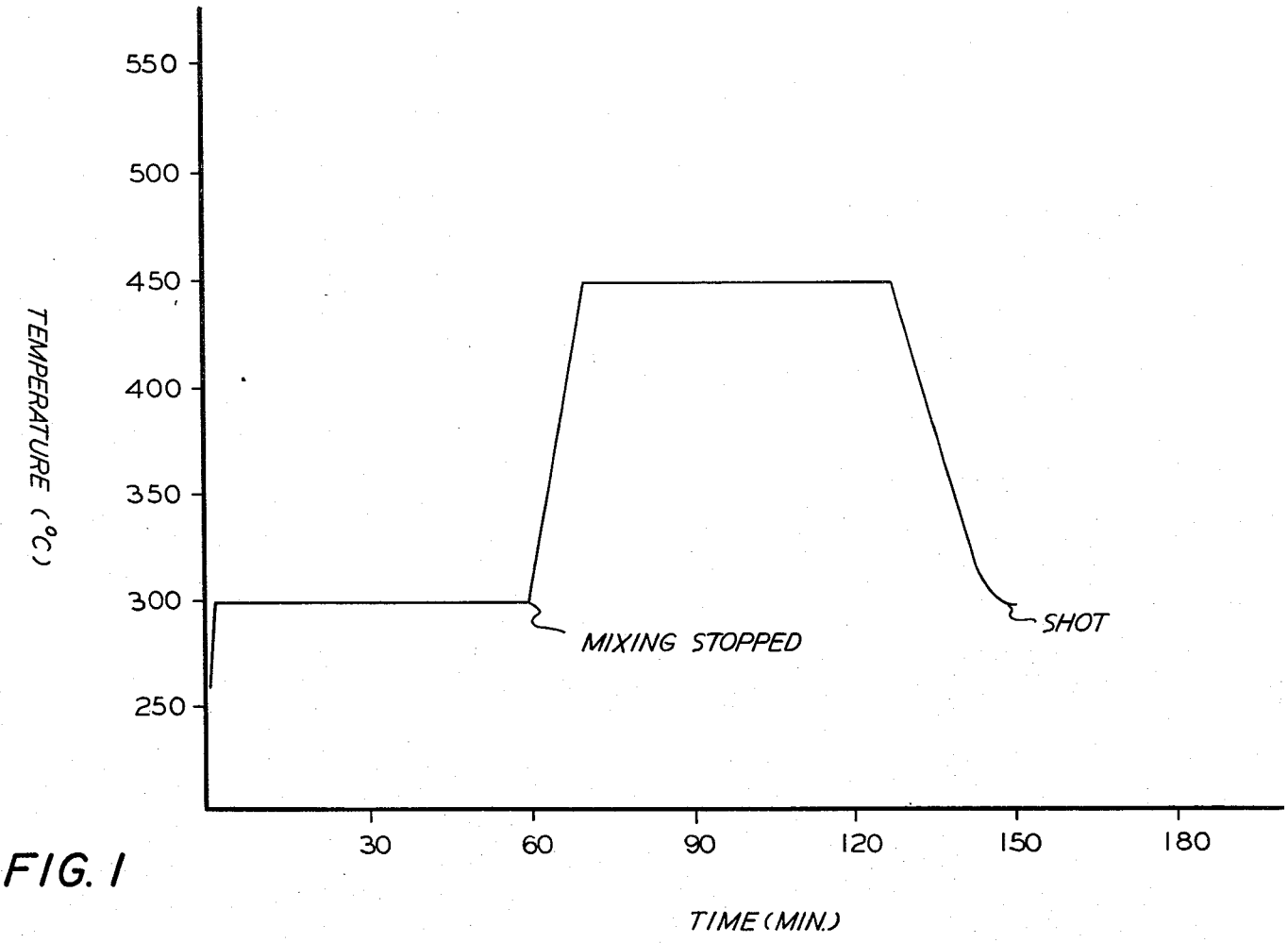
FIG. 1 illustrates one embodiment of the relationship between temperature and time in the process of the instant invention.
Figure 2:
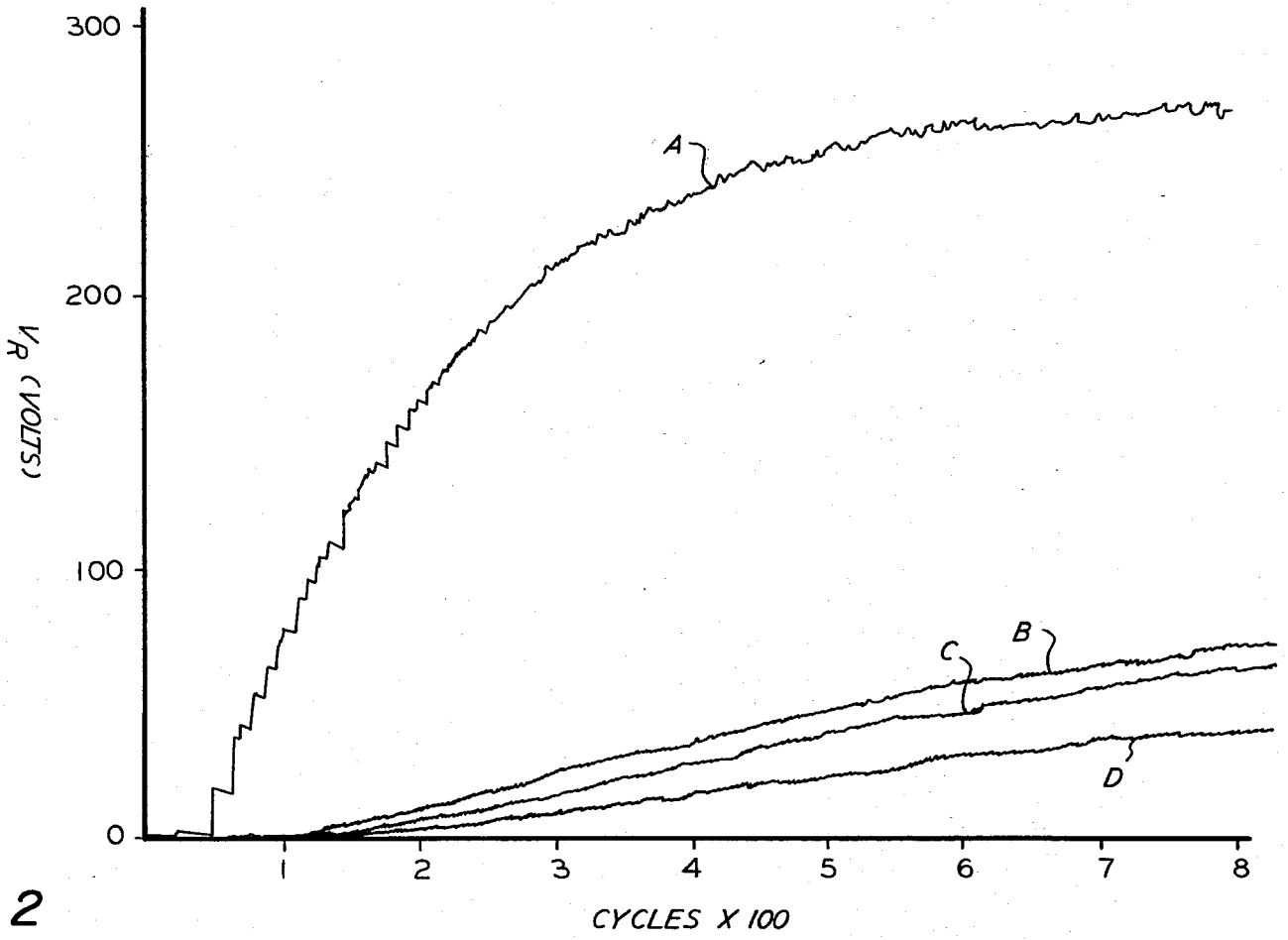
FIG. 2 illustrates cycle-up characteristics of alloys prepared with and without the quiescent state step of the instant invention.

A molten mixture of about one kilogram of selenium shot having an overall dopant content of about 0.36 percent by weight arsenic and about 110 ppm chlorine was formed in a three port quartz round bottom vessel by means of heat applied by a Glasscol heating mantle to raise the mixture temperature to about 300° C. Temperatures were controlled by a Barber-Coleman 520 Controller and monitored by a Doric Digitrend 200 recorder via Omega Chromel-Alumel thermocouples in quartz sheaths inserted into the flask as near center as possible. Mixing was initiated at about 300° C. by means of a helical quartz stirrer immersed in the molten alloy mixture. The stirrer was rotated at about 60 revolutions per minute. A nitrogen sparge gas was introduced through a quartz tube immersed in the molten mixture, at the rate of about 800 to about 1,000 $cm^3$/min. The sparge gas was allowed to escape through an open port of the vessel. Mixing and sparging were terminated after about 60 minutes and the temperature of the molten mixture was increased to about 450° C. The molten alloy was maintained in a quiescent state at this elevated temperature without any agitation for about 1 hour. At the end of the quiescent state treatment, the temperature of the molten mixture was reduced to about 300° C. The ports of the quartz vessel were then sealed and positive pressure was then applied with nitrogen gas against the surface of the molten alloy to force the molten alloy through an inverted U-shaped quartz tube having one end immersed in the molten alloy to force the molten alloy to travel to the other end of the quartz tube which was fitted with a shotter head which broke the molten alloy into droplets. The temperature and times utilized in this process are illustrated in FIG. 2. The droplets from the shotter head were allowed to fall into a bath of deionized water maintained at a temperature of about 25° C. The resulting alloy shot particles were then dried.

EXAMPLE II

The steps described in Example I were repeated except that the quiescent state step at elevated temperatures was eliminated. The resulting selenium alloy contained selenium, about 0.33 percent by weight arsenic, and about 100 ppm chlorine. This alloy was vacuum deposited in an 18 inch bell jar onto a 2½ inch by 3 inch nickel substrate coated with a resin adhesive layer to form a photoconductive selenium layer having a thickness of about 60 microns. This photoreceptor was then passed under a constant current (through the photoreceptor) positive DC corotron. The current was adjusted so that the surface potential was about 750 volts during the first cycle at 0.6 second after charging. A pulsed laser (wavelength 337 nm, pulsewidth 4 n sec) was used to illuminate the photoreceptor at 0.6 sec. after charging, discharging the photoreceptor approximately 20 volts in about 200 n sec., the transit time for positive charge at this field. The photoreceptor was then recharged by the DC corotron by providing a positive constant current equal to about 0.67 times the initial charging current. During photoreceptor recharging, the region underneath the corotron as well as the adjacent areas were illuminated by a 200 watt mercury-xenon lamp filtered to remove essentially all radiation from 550 nm to 1,000 nm. The sample was therefore discharged to a residual voltage before recharging with a recharge corotron and is left at perhaps a different residual voltage after it leaves the recharge corotron. The photoreceptor then is illuminated by a shuttered post-discharge tungsten-halide erase lamp (color temperature approximately 3,000 K) emitting radiation in the spectral region between 640 nm and 1,050 nm. Each cycle was completed in about 3.1 seconds. The cycle was repeated 800 times with the residual potential being measured at the surface of the photoconductor at the end of each cycle with a Monroe electrostatic probe. The residual potential was then plotted as voltage relative to cycles and is illustrated by curve A in FIG. 2.

EXAMPLE III

A selenium alloy was prepared under the conditions described in Example I to form a selenium alloy doped with about 0.33 percent by weight arsenic and about 100 ppm chlorine. This alloy was vacuum deposited in the manner described in Example II onto a nickel substrate coated with a resin identical to the coated substrate used in Example II to form a photoconductive layer having a thickness of about 60 microns. Two additional photoreceptors were prepared in substantially the same manner to form about 60 micron thick selenium alloys doped with about 0.33 percent by weight arsenic and about 100 ppm chlorine. These three photoreceptors were charged, exposed and erased in exactly the same manner as described in Example II. The residual voltage of these three photoreceptors at the end of each cycle were plotted and are shown as curves B, C, and D in FIG. 2. Although the preparation process, alloy composition and photoreceptor thickness of all three photoconductive plates were substantially identical, there was a slight variation in residual charge build-up in the three plates B, C and D, as shown in FIG. 2. This variation is believed to be due to experimental variation. The three alloys illustrated in curves B, C and D, made by the process of the present invention, exhibit a residual voltage of about 40–60 volts after 800 cycles, whereas the alloy prepared without a quiescent state step at elevated temperature as described in Example II and illustrated in curve A of FIG. 2, exhibits a residual voltage of about 270 volts after 800 cycles. The average improvement in performance of the alloys represented by curves B, C, and D is about five times greater than the performance of the alloy represented by curve A.

EXAMPLE IV

The process described in Example I was repeated except that the temperature of the molten alloy mixture was raised from about 300° C. to about 500° C. instead of 450° C. as in Example I. The resulting alloy exhibited low residual potential behavior similar to that of the alloys described in Example III when tested as described in Example III.

EXAMPLE V

The process described in Example I was repeated except that the temperature of the molten alloy mixture was raised from about 300° C. to about 425° C. instead of 450° C. as in Example I. The resulting alloy exhibited low residual potential behavior similar to that of the alloys described in Example III when tested as described in Example III.

EXAMPLE VI

A molten mixture of about one kilogram of selenium shot having an overall dopant content of about 0.36 percent by weight arsenic and about 110 ppm chlorine was processed in equipment described in Example I. The mixture was heated to about 300° C. Mixing was begun when the mixture reached about 300° C. and continued for about two hours. At the end of the mixing treatment, positive pressure was applied with carbon dioxide gas against the surface of the molten alloy to force the alloy through an inverted U-shaped quartz tube as described in Example I. Considerable volatiles were lost and high residual potential was observed when the alloy of this example was tested as a photoreceptor using the procedures of Example II.

EXAMPLE VII

A molten mixture of about 27 kilogram of selenium shot having an overall dopant content of about 0.37 percent by weight arsenic and about 130 ppm chlorine was processed in equipment described in Example I. The mixture was initially heated to about 300° C. Mixing was begun when the mixture reached about 300° C. and continued for about 60 minutes. After mixing, the temperature of the molten mixture was increased to about 450° C. The molten alloy was maintained in a quiescent state at this elevated temperature without any agitation for about 60 minutes. At the end of the quiescent state treatment, the temperature of the molten mixture was reduced to about 300° C. Positive pressure was then applied with carbon dioxide gas against the surface of the molten alloy to force the alloy through an inverted U-shaped quartz tube as described in Example I. Low residual potential was observed when the alloy of this example was tested as a photoreceptor using the procedures of Example II.

EXAMPLE VIII

A mixture of about 15 kilograms of high purity selenium shot particles, about 0.6 kilogram of selenium shot having a dopant content of about 10 percent by weight arsenic, and about 0.6 kilogram of selenium shot having a dopant content of about 3,500 ppm chlorine was premixed by stirring in a stainless steel beaker for about 10 minutes at room temperature. After completion of the premixing step, the mixture was transferred to a 7 liter quartz flask and heated to about 300° C. Mixing was begun when the mixture reached about 300° C. and continued for about 60 minutes. Mixing was then terminated and the temperature of the molten mixture was increased to about 450° C. The molten alloy was maintained in a quiescent state at this elevated temperature for about 60 minutes. At the end of the quiescent state treatment, the temperature of the molten mixture was reduced to about 300° C. The quartz vesel was then sealed and positive pressure was applied with carbon dioxide gas against the surface of the molten alloy to force the alloy through an inverted U-shaped quartz tube as described in Example I. The resulting alloy was vacuum deposited on a nickel belt coated with a resin adhesive layer and used in a Xerox 9500 duplicator for thousands of imaging cycles with excellent cycle-up control.

The invention has been described in detail with particular reference to prefered embodiments thereof but it will be understood that variations and modifications can be effected within the spirit and scope of the invention as described hereinabove and as defined in the appended claims.

I claim:

1. A process for preparing a photoconductive insulating alloy comprising selenium, about 0.3 percent by weight to about 0.5 percent by weight arsenic, based on the total weight of said alloy, and about 50 ppm to about 150 ppm chlorine, based on the total weight of said alloy comprising heating a mixture comprising sufficient selenium, arsenic and chlorine to a temperature between about 290° C. and about 330° C. to form a molten mixture, agitating said molten mixture to blend said selenium, arsenic and chlorine, discontinuing or substantially discontinuing all agitation of said molten mixture, heating said molten mixture to a temperature of at least about 420° C. for at least about 30 minutes, and cooling said mixture until it becomes a solid.

2. A process according to claim 1 including heating said mixture to said temperature between about 290° C. and about 330° C. in a vessel open to the atmosphere.

3. A process according to claim 1 comprising heating said molten mixture to a temperature between about 425° C. and about 500° C. for between about 30 minutes and about 3 hours after discontinuing or substantially discontinuing agitation of said molten mixture.

4. The process according to claim 3 wherein said molten mixture is heated to a temperature of about 450° C. for between about 1 hour to about 2 hours after discontinuing or substantially discontinuing agitation of said molten mixture.

5. The process according to claim 1 including agitating said molten mixture to blend said selenium, arsenic and chlorine for a period between about 30 minutes to about 1 hour, 30 minutes.

6. A process according to claim 1 including preparing said photoconductive insulating alloy in a substantially inert atmosphere.

7. A process according to claim 1 including cooling said molten mixture to a temperature between about 290° C. and about 310° C., forming said molten alloy into droplets and cooling said droplets to form solid shot.

8. A process according to claim 1 wherein said mixture heated to said temperature between about 290° C. and about 330° C. initially comprises up to about 10 percent by weight excess arsenic and up to about 10 percent by weight excess chlorine.

9. A process according to claim 1 wherein said mixture is premixed by stirring shot particles comprising high purity selenium, shot particles comprising selenium and arsenic, and shot particles comprising selenium and chlorine prior to heating said mixture to a temperature of between about 290° C. and about 300° C.

10. A process for preparing an photoconductive insulating alloy comprising selenium, about 0.3 percent by weight to about 0.5 percent by weight arsenic, based on the total weight of said alloy, and about 50 ppm to about 150 ppm chlorine, based on the total weight of said alloy comprising heating a mixture comprising sufficient selenium, arsenic, and chlorine to a temperature between about 290° C. and about 330° C. to form a molten mixture, agitating said molten mixture for between about 30 minutes and about 3 hours to blend the said selenium, arsenic and chlorine, discontinuing or substantially discontinuing all agitation of said molten mixture, heating said molten mixture to a temperature of at least about 420° C. for between about 30 minutes and about 3 hours and cooling said mixture until it becomes a solid.

* * * * *